US006391065B1

(12) United States Patent
Cooke

(10) Patent No.: US 6,391,065 B1
(45) Date of Patent: May 21, 2002

(54) UV LIGHT ABSORBER COMPOSITION AND METHOD OF IMPROVING THE LIGHTFASTNESS OF DYED TEXTILES

(75) Inventor: Thomas W. Cooke, Greensboro, NC (US)

(73) Assignee: Boehme Filatex, Inc., Reidsville, NC (US)

( * ) Notice: Subject to any disclaimer, the term of this patent is extended or adjusted under 35 U.S.C. 154(b) by 968 days.

(21) Appl. No.: 08/553,072

(22) Filed: Nov. 3, 1995

(51) Int. Cl.[7] ..... D06P 5/02; D06P 5/00; C09K 11/06

(52) U.S. Cl. ..... 8/442; 8/490; 8/573; 8/574; 8/576; 252/301.25; 252/301.29

(58) Field of Search ..... 8/490, 442, 573, 8/574, 576; 252/301.25, 301.29

(56) References Cited

U.S. PATENT DOCUMENTS

| | | | | | |
|---|---|---|---|---|---|
| 4,230,867 | A | * | 10/1980 | Kintopf et al. | 548/260 |
| 4,557,730 | A | * | 12/1985 | Bennett et al. | 8/442 |
| 4,775,386 | A | * | 10/1988 | Reinert et al. | 8/442 |
| 4,812,139 | A | * | 3/1989 | Brodmann | 8/490 |
| 4,940,469 | A | | 7/1990 | Möckel et al. | |
| 4,957,682 | A | * | 9/1990 | Kobayashi et al. | 264/255 |
| 5,009,669 | A | | 4/1991 | Jöllenbeck et al. | |
| 5,143,729 | A | * | 9/1992 | Thompson | 424/402 |
| 5,221,287 | A | | 6/1993 | Reinert | |
| 5,268,450 | A | * | 12/1993 | Des Lauriers | 528/388 |
| 5,360,559 | A | | 11/1994 | Cooke | |
| 5,374,362 | A | * | 12/1994 | McFarland | 252/8.6 |

FOREIGN PATENT DOCUMENTS

| | | | |
|---|---|---|---|
| EP | 0 245 204 | A1 | 11/1987 |
| EP | 0 468 921 | A1 | 1/1992 |
| EP | 0 490 819 | A1 | 6/1992 |
| GB | 2187746 | A | 9/1987 |

OTHER PUBLICATIONS

Trotman, Dyeing and Chemical Technology of Textile Fibres, 6th Edition 1984 pp. 489–490.*

* cited by examiner

*Primary Examiner*—Margaret Einsmann
(74) *Attorney, Agent, or Firm*—Adams, Schwartz & Evans, P.A.

(57) ABSTRACT

A water-dilutable UV light absorber composition and method for improving the lightfastness of dyed textiles is provided. The composition includes from about 5–75% by weight of an ultraviolet light absorbing agent selected from the group consisting of benzotriazole, benzophenone, and phenol substituted triazine; and from about 25–95% by weight of an organic solvent suitable for dissolving the ultraviolet light absorbing agent. The ultraviolet light absorbing agent is applied to the textiles in a concentration sufficient to result in an add-on in the range of between 0.4–4.0% by weight of the textiles when dry.

6 Claims, No Drawings

UV LIGHT ABSORBER COMPOSITION AND METHOD OF IMPROVING THE LIGHTFASTNESS OF DYED TEXTILES

TECHNICAL FIELD AND BACKGROUND OF THE INVENTION

This invention relates to an ultraviolet light absorber composition which is readily diluted in, and applied from, a water-based textile dye bath to improve the lightfastness, or fade-resistance, of a dyed textile material, for example, knitted or woven fabric. The invention is based upon the synergistic combination of a UV light absorber and a suitable solvent. When using a water immiscible solvent, a solvent-soluble emulsifier (surfactant) is added such that the resulting composition spontaneously forms an emulsion when diluted in water. The emulsifier may also be applicable when using a water miscible solvent to improve the dilutability of the UV light absorber. The water miscible solvent dissolves in the water-based dye bath to form an extremely fine dispersion of UV light absorber.

The dyed textiles treatable by this invention generally include synthetic fibers, such as polyester and nylon (polyamide). According to one application, the invention is applied to disperse-dyed polyester fabric used in automobile interiors, for example, in seat upholstery, door and head liners, and carpeting, to improve the fade-resistance of the fabric.

In order to apply UV light absorbers and other light stabilizers to textiles after the textile fiber has been formed rather than in the melt-extrusion stage, the absorber/stabilizer agents must be dilutable in water to be effectively used in conventional textile dyeing and processing machinery. Standard UV light absorber and light stabilizer compounds, however, have little or no solubility in water, and must therefore be wet-milled. Wet-milling is a process of mechanically, grinding down the absorber/stabilizer agents in water in small media mills, e.g., sand mills or ball mills, together with various dispersing and wetting agents, processing aids, and the like. Other ingredients such as leveling agents, particle recrystallization inhibitors, preservatives, defoamers, and thickeners are also generally required.

Although reasonably effective, the wet-mill process suffers from numerous drawbacks and limitations. A great deal of time and energy is required to physically break down the absorber/stabilizer agents. Typically, the particle size must be less than two microns mean diameter in order to produce a suitable aqueous dispersion that is both storage stable, and will not filter out when passed through many layers of fiber or fabric in conventional dyeing machinery, such as in package or beam dyeing machines. The wet-mill process may take as long as several days for a single preparation.

SUMMARY OF THE INVENTION

Therefore, it is an object of the invention to provide a UV light absorber composition which spontaneously dilutes in a water-based dye bath.

It is another object of the invention to provide a UV light absorber composition which is easily made in a relatively short time—within minutes to a couple of hours.

It is another object of the invention to provide a UV light absorber composition which does not require the use of expensive capital equipment, such as sand mills or ball mills.

It is another object of the invention to provide a UV light absorber composition which requires minimal energy to produce—for example, simple mixing at room temperature.

It is another object of the invention to provide a UV light absorber composition which is storage stable, and thus will not settle out or recrystallize over time as in wet-milled dispersions.

It is another object of the invention to provide a UV light absorber composition which is non-aqueous, and thus will not support the growth of microorganisms, such as mold, fungus, and bacteria.

It is another object of the invention to provide a method of improving the lightfastness of dyed textiles.

These and other objects of the present invention are achieved in the preferred embodiments disclosed below by providing a UV light absorber composition for improving the lightfastness of dyed textiles. The composition includes from about 5–75% by weight of an ultraviolet light absorbing agent selected from the group consisting of benzotriazole, benzophenone, and phenol substituted triazine; and from about 25–95% by weight of an organic solvent suitable for dissolving the ultraviolet light absorbing agent. The ultraviolet light absorbing agent is applied to the textiles in a concentration sufficient to result in an add-on in the range of between 0.4–4.0% by weight of the textiles when dry.

According to one preferred embodiment of the invention, the organic solvent is a water miscible solvent.

According to another preferred embodiment of the invention, the organic solvent is a water immiscible solvent, and the composition further includes from about 2–25% by weight of a surfactant.

Preferably, the surfactant is nonylphenoxy-polypropyleneoxy-polyethyleneoxy-ethanol.

According to another preferred embodiment of the invention, the composition includes from about 2–25% by weight of a surfactant in a water miscible solvent.

According to yet another preferred embodiment of the invention, the composition includes an additional light stabilizer selected from the group including hindered amines and organo-copper complexes.

According to yet another preferred embodiment of the invention, the composition includes an anti-oxidant.

Preferably, the UV light absorbing agent is 2-(2-hydroxy-5-tert-octylphenyl)-benzotriazole.

Preferably, the organic solvent is N-methyl-pyrrolidone.

Preferably, the ultraviolet light absorbing agent is applied to the textiles in a concentration sufficient to result in an add-on of approximately 1.0% by weight of the textiles when dry.

According to one preferred embodiment of the invention, a UV light absorber composition for improving the lightfastness of dyed textiles includes from about 10–30% by weight of 2-(2-hydroxy-5-tert-octylphenyl)-benzotriazole, from about 55–85% by weight of N-methyl-pyrrolidone solvent, and from about 5–15% by weight of nonylphenoxy-polypropyleneoxy-polyethyleneoxy-ethanol. The benzotriazole is applied to the textiles in a concentration sufficient to result in an add-on in the range of between 0.4–4.0% by weight of the textiles when dry.

An embodiment of the method according to the invention comprises the steps of formulating a UV light absorbing composition. The composition includes from about 5–75% by weight of an ultraviolet light absorbing agent selected from the group consisting of benzotriazole, benzophenone, and phenol substituted triazine; and from about 25–95% by weight of an organic solvent suitable for dissolving the ultraviolet light absorbing agent. The ultraviolet light absorbing agent is applied to the textiles in a concentration sufficient to result in an add-on in the range of between 0.4–4.0% by weight of the textiles when dry. The method further includes adding the above composition and textiles to be treated into a water-based dye bath.

According to one preferred embodiment of the invention, the method includes the step of scouring the textiles with a scouring agent prior to adding the textiles to the water-based dye bath.

According to another preferred embodiment of the invention, the method includes the step of heating the textiles after scouring to a temperature in the range of about 60° C. to about 80° C. at a rate of 2° C. per minute, and prior to adding the textiles to the dye bath.

According to yet another preferred embodiment of the invention, the method includes the step of drying the textiles prior to adding the textiles to the dye bath.

According to yet another preferred embodiment of the invention, the step of formulating a UV light absorbing composition includes the step of adjusting the pH of the composition to between about 4.0 and 5.0 prior to adding the composition to the dye bath.

Preferably, the step of formulating a UV light absorbing composition includes the step of adjusting the pH of the composition to about 4.8 prior to adding the composition to the dye bath.

DETAILED OF THE PREFERRED EMBODIMENT AND BEST MODE

The UV light absorber composition of the present invention is a non-aqueous composition usable in water-based dye baths for enhancing the lightfastness of dyed textiles. The composition includes a mixture of at least a UV light absorbing agent and a suitable solvent. For a water immiscible or partially immiscible solvent, the composition further includes an emulsifier such that the composition spontaneously forms an emulsion when diluted in water. An emulsifier may also be used with water miscible solvents to improve the dilutability of the composition in the dye bath.

The UV light absorbing agent is chosen from one or more of the following classes; benzotriazole, benzophenone, and phenol substituted triazine. Preferably, these agents are used individually, but may be used in combination to obtain various mixtures of active UV light absorbing ingredients. One preferred benzotriazole UV light absorbing agent is 2-(2-Hydroxy-5-tert-octylphenyl)-benzotriazole, CAS Reg. No. 3147-75-9, which is commercially available as "Cyasorb UV-5411" from Cytec Industries. Examples of suitable benzophenones and phenol substituted triazines are disclosed in U.S. Pat. Nos. 4,826,978 and 4,964,871. A number of other commercially available UV light absorbing agents are set forth in the Examples provided below.

The solvent may be any suitable water miscible or immiscible organic solution, or mixture of water miscible and immiscible solutions, capable of dissolving the active UV light absorbing agent of the composition. For compositions using a water immiscible or partially immiscible solvent, the solvent must further be capable of dissolving the added emulsifier. A number of applicable solvents are provided in the Examples below. In addition, for water insoluble dyes, such as disperse dyes, the solvent can function as a carrier or diffusion accelerator for the UV light absorbing agent into hydrophobic fibers, such as polyester. Solvents chosen from the class of plasticizer esters are especially suitable for this purpose.

The emulsifier is preferably chosen from the group including alkanolamides, ethylene oxide/propylene oxide block polymers, alkylphenol ethoxylates, dialkylphenol ethoxylates, styrenated-phenol ethoxylates, ethoxylated alcohols, ethoxylated fatty acids (esters), ethoxylated amines, ethoxylated amides, glycerol esters, ethoxylated glycerol esters, sorbitan esters, ethoxylated sorbitan esters, sucrose and glucose esters, alkyl polyglycosides, ethoxylated alkyl thiols, ethoxylated thio-ethers. Wherever the terms "ethoxylated" or "ethoxylates" are used, the ethoxylated/propoxylated variations could also be used. A listing of suitable commercially available emulsifiers is provided in *McCutcheon's Emulsifiers and Detergents* 1994—North American and International Editions (McCutcheon Division, MC Publishing, 175 Rock Road, Glen Rock, N.J. 07452).

For applicability to the present UV light absorbing composition, the emulsifier selected must be soluble in the particular water miscible or immiscible solvent used. Generally, to be soluble in such solvents, the hydrophilic-lipophilic balance (HLB) of the emulsifier should be less than about 13. The most preferred nonionic emulsifiers should have HLBs of about 5 to 11.

In addition, certain ionic emulsifiers may be used in the present composition, provided they are sufficiently soluble in the solvent. However, because many dye baths typically contain anionic dispersants, the ionic emulsifier used should also be anionic or possibly amphoteric. Cationic emulsifiers may not be compatible in the final dye baths where the UV light absorbing composition would commonly be applied.

According to one preferred embodiment, the UV light absorber composition includes approximately 5–75% of organic UV light absorbing agent; approximately 25–95% of organic solvent; and for water immiscible or partially immiscible solvents, approximately 2–25% of an emulsifier which is soluble in the above mixture. The solvent must therefore be capable of dissolving at least 5% of a UV light absorbing agent, and at least 2% of an emulsifier when applicable.

In alternative embodiments, the UV light absorbing agent of the composition is combined with other classes of light stabilizers, such as hindered amines and organo-copper complexes; and/or various anti-oxidant compounds to achieve synergistic lightfastness and fiber protection effects. One suitable hindered amine is Bis(1,2,2,6,6-pentamethyl-4-piperidinyl)sebacate, commercially available as "Tinuvin 292" from Ciba-Geigy. Examples of suitable organo-copper complexes are described in U.S. Pat. Nos. 4,990,164 and 5,076,808. One suitable anti-oxidant compound is "Cyanox 2777" from Cytec Industries.

The present UV light absorbing composition is applicable in beam and package dyeing of textiles, and dyeing operations where the dye bath liquor is stationary and the fabric is moving, such as in jet dyeing and continuous dyeing machines.

The following Examples are compositions formulated according to the present invention. Information appearing in brackets beside selected Examples relates to the testing ID of the particular sample composition as referenced in Tables 1–4.

EXAMPLE 1

A solution of 5 g D-Limonene (CAS No. 5989-27-5) and 5 g "Cyasorb UV-5411" was mixed and heated. The mixture formed a clear yellow solution down to 55° C. An additional 5 g D-Limonene was then added. The mixture formed a clear solution down to 45° C. To this was added 5 g of a nonionic emulsifier, nonylphenoxy-polypropyleneoxy-polyethyleneoxy-ethanol (CAS Reg. No. 68891-11-2), commercially available as "Tergitol D-683" from Union Carbide. The mixture formed a clear solution down to 40° C., but was an opaque off-white "slush" at room temperature. The resulting solution was relatively dispersible in warm water (45–50° C.) with stirring.

EXAMPLE 2

Into 20 g D-Limonene (CAS Reg. No. 5989-27-5) stirred at room temperature, slowly added 4.7 g "Cyasorb UV-5411" with stirring. The mixture changed from a clear yellow to a hazy solution, and remained hazy. Then back-added 1.4 g additional D-Limonene until mixture returned to a clear yellow solution. Therefore, 4.7 g "Cyasorb UV-5411" dissolved in 21.4 g D-Limonene solvent for 18% solubility of active UV light absorber.

The following mixtures were made with 4.5 g portions of the above solution:

(a) 0.5 g "Tergitol D-683," nonionic emulsifier from Union Carbide (CAS Reg. No. 68891-11-2). This formed a clear solution which resulted in a white emulsion when diluted in water;

(b) 0.5 g "Ethox 2938," nonionic emulsifier from Ethox (CAS No. 104376-75-2)(polyoxyethylene-distyryl-phenylether). This formed a hazy solution, and resulted in a relatively whitish emulsion when diluted in water.

(c) 0.5 g "Neodol 25-3," nonionic emulsifier from Shell (CAS No. 68131-39-5)(alcohol ethoxylate). This produced a clear solution which resulted in a nice white emulsion when diluted in water.

EXAMPLE 3

Into 20.0 g benzyl-benzoate (CAS Reg. No. 120-51-4), slowly added 2.9 g "Cyasorb UV-5411" until solution remained cloudy when stirring at room temperature. Then with stirring, back-added an additional 3.6 g benzyl-benzoate until solution became clear again. Therefore, 2.9 g "Cyasorb UV-5411" dissolved in 23.6 g benzyl-benzoate for 10.9% solubility of active UV light absorber.

EXAMPLE 4

Tested as VP-2017C

Into 80 g of benzyl-benzoate (CAS Reg. No. 120-51-4), 10 g of "Cyasorb UV 5411" was added over a 5 minute period with stirring at room temperature. The mixture was stirred for an additional 10 minutes. Over a subsequent 5 minute period, added 10 g of "Tergitol D-683" nonionic emulsifier to the mixture with stirring. The mixture formed a clear, pale-yellow solution which resulted in an opaque-white emulsion when diluted in water.

EXAMPLE 5

Into 20.0 g "Naugard 529" liquid anti-oxidant/solvent (CAS Reg. No. 68457-75-0)(alkylated-styrenated p-cresol), added 10.0 g of benzyl-benzoate (CAS Reg. No. 120-51-4) to reduce viscosity. Then gradually added 3.5 g "Cyasorb UV-5411" with stirring at room temperature. The mixture remained a relatively clear, viscous, pale-yellow solution. Then added 1.0 g additional "Cyasorb UV-5411". After stirring, mixture remained hazy—not fully dissolved. Therefore, solubility was greater that 10.4% but less than 13.0%.

EXAMPLE 6

Into 20 g butyl benzoate (CAS Reg. No. 136-60-7), slowly added 4.4 g "Cyasorb UV-5411" with stirring until mixture remained hazy. Then back-added 4.4 g additional butyl benzoate to return mixture to a clear solution. Therefore, 4.4 g "Cyasorb UV-5411" dissolved in 24.4 g butyl benzoate for 15.3% solubility of active UV light absorber.

EXAMPLE 7

Tested as VP-2018D

Into 77.0 g butyl benzoate (CAS Reg. No. 136-60-7), added 13.0 g of "Cyasorb UV-5411" at room temperature with stirring. Then slowly added 10.0 g of "Tergitol D-683" nonionic emulsifier (CAS Reg. No. 68891-11-2) with stirring. The mixture formed a clear, light-yellow solution which resulted in a whitish emulsion when diluted in water.

EXAMPLE 8

Tested as VP 2021A

The following mixture was prepared with stirring at room temperature:

(a) 36 g "M-Pyrol" from ISP (CAS Reg. No. 872-50-4) (N-methyl Pyrrolidone);

(b) 9.0 g "Cyasorb UV-2908" light stabilizer from Cytec (CAS Reg. No. 67845-93-6)(3,5-di-butyl-4-hydroxy benzoic acid, hexadecylester);

(c) 36.0 g butyl benzoate (CAS Reg. No. 136-60-7);

(d) 9.0 g "Cyasorb UV-5411" UV light absorber; and (e) 10.0 g "Tergitol D-683" emulsifier.

The mixture formed a clear yellow solution which resulted in an opaque white emulsion when diluted in water.

EXAMPLE 9

Tested as VP 2021B

The following mixture was prepared with stirring at room temperature:

(a) 36 g "M-Pyrol";

(b) 6.0 g "Cyanox 1790" anti-oxidant (CAS Reg. No. 40601-76-1)(tris-(4-t-butyl-3-hydroxy-2,6-dimethyl-benzyl)-s-triazine-2,4,6-trione);

(c) 36.0 g butyl benzoate (CAS Reg. No. 136-60-7);

(d) 12.0 g "Cyasorb UV-5411" UV light absorber; and (e) 10.0 g "Tergitol D-683" emulsifier.

The mixture formed a clear yellow solution which resulted in an opaque white emulsion when diluted in water.

EXAMPLE 10

Into 20.0 g of "Jayflex DIOP" plasticizer from Exxon (CAS Reg. No. 27554-26-3)(diisooctyl phthalate), slowly added 2.2 g "Cyasorb UV-5411" until mixture remained a cloudy solution when stirring at room temperature. Then with stirring, back-added additional 1.4 g "Jayflex DIOP" until mixture returned to a clear solution. The solution had a slight yellow clear appearance. Therefore, 2.2 g of "Cyasorb UV-5411" dissolved in 21.4 g of "Jayflex DIOP" for 9.3% solubility of active UV light absorber.

EXAMPLE 11

Tested as VP 2305A

Into the solution of Example 10 including 81% by weight "Jayflex DIOP" plasticizer and 9% by weight "Cyasorb UV-5411", slowly added 10% by weight "Tergitol D-683" emulsifier while stirring. The resulting solution forms an opaque white emulsion when diluted in water.

EXAMPLE 12

Into 20.0 g of N-methyl pyrrolidone (CAS Reg. No. 872-50-4), slowly added 7.0 g of "Cyasorb UV-5411" until mixture remained a cloudy solution when stirring at room temperature. Then with stirring, back-added an additional 0.7 g of N-methyl pyrrolidone until mixture returned to a clear solution. Solution had a light yellow clear appearance which formed a cloudy emulsion with insoluble precipitates when diluted in water. Therefore, 7.0 g "Cyasorb UV-5411" dissolved in 20.7 g N-methyl pyrrolidone for 25.3% solubility of active UV light absorber.

EXAMPLE 13

Tested as VP 2305B

Into the solution of Example 12 including 67.5% by weight N-methyl pyrrolidone and 22.5% by weight "Cyasorb UV-5411", slowly added 10% by weight of "Tergitol D-683" emulsifier. The solution formed a cloudy, pearlescent emulsion when diluted in water.

EXAMPLE 14

Into 20 g of 50% by weight N-methyl pyrrolidone and 50% by weight butyl benzoate (CAS Reg. No. 136-60-7), slowly added 6.2 g "Cyasorb UV-5411" until the mixture remained cloudy when stirring at room temperature. Then with stirring, back-added an additional 1.7 g of 50/50 N-methyl pyrrolidone and butyl benzoate until mixture returned to a clear solution. Therefore, 6.2 g "Cyasorb UV-5411" dissolved in 21.7 g of 50/50 N-methyl pyrrolidone and butyl benzoate for 22.2% solubility of active UV light absorber. The solution had a light yellow clear appearance, but when diluted in water, it was not miscible.

EXAMPLE 15

Tested as VP 2305C

Into a pre-mixed solution containing 35.1 g of N-methyl pyrrolidone and 35.1 g of butyl benzoate, added and dissolved 19.8 g "Cyasorb UV-5411". Then with stirring, added 10.0 g "Tergitol D-683" emulsifier. The resulting solution formed a white emulsion when diluted in water.

EXAMPLE 16

Into 20.0 g of tetrahydrofurfuryl alcohol (CAS Reg. No. 97-99-4), slowly added 1.7 g "Cyasorb UV-5411" until mixture remained cloudy. Then with stirring, back-added an additional 8.2 g tetrahydrofurfuryl alcohol until mixture returned to a clear solution. Therefore, 1.7 g "Cyasorb UV-5411" dissolved in 28.2 g tetrahydrofurfuryl alcohol for 5.7% solubility of active UV light absorber.

EXAMPLE 17

Into 20.0 g of tetramethylene sulfone (CAS Reg. No. 126-33-0), slowly added 0.4 g "Cyasorb UV-5411" until mixture remained cloudy when stirring at room temperature. Then with stirring, back-added an additional 35.0 g tetramethylene sulfone until mixture returned to a clear solution. Therefore, 0.4 g "Cyasorb UV-5411" dissolved in 55.0 g of tetramethylene sulfone for 0.72% solubility of active UV light absorber.

EXAMPLE 18

Into 20.0 g dimethyl sulfoxide (CAS Reg. No. 67-68-5), slowly added 0.6 g "Cyasorb UV-5411" until mixture remained cloudy when stirring at room temperature. Then with stirring, back-added an additional 19.3 g dimethyl sulfoxide until mixture returned to a clear solution. Therefore, 0.6 g "Cyasorb UV-5411" dissolved in 39.3 g of dimethyl sulfoxide for 1.5% solubility of active UV light absorber.

EXAMPLE 19

Into 20.0 g of gamma-butyrolactone (CAS Reg. No. 96-48-0), slowly added 0.5 g "Cyasorb UV-5411" until mixture remained cloudy when stirring at room temperature. Then with stirring, back-added an additional 4.5 g gamma-butyrolactone until mixture returned to a clear solution. Therefore, 0.5 g "Cyasorb UV-5411" dissolved in 24.5 g of gamma-butyrolactone for 2.0% solubility of active UV light absorber.

EXAMPLE 20

Into 20.0 g of tricresyl phosphate (CAS Reg. No. 1330-78-5), slowly added 1.6 g "Cyasorb UV-5411" until mixture remained cloudy when stirring at room temperature. Then with stirring, back-added an additional 3.8 g tricresyl phosphate until mixture returned to a clear solution. Therefore, 1.6 g "Cyasorb UV-5411" dissolved in 23.8 g of tricresyl phosphate for 6.3% solubility of active UV light absorber.

As shown below in Table 1, several of the above Examples were tested against a commercially available wet-milled UV light absorber, "Sandolite LP" from Sandoz, Ltd., to determine the relative effectiveness of the UV light absorber compositions formulated according to the present invention. A typical wet-milled UV light absorber of this type is described in published UK Patent No. GB 2,187,746, issued to Sandoz, Ltd. The entire disclosure of this patent is incorporated herein by reference.

TABLE 1

| | | FORMULATIONS (Grams/100 grams) | | | | | | | |
|---|---|---|---|---|---|---|---|---|---|
| | | Mix Number | | | | | | | |
| Product | Activity (%) | A | B | C | D | E | F | G | H |
| VP 2305-A | 9.0 | 1.1 | — | — | — | — | — | — | — |
| VP 2305-B | 22.5 | — | 0.44 | — | — | — | — | — | — |
| VP 2305-C | 19.8 | — | — | 0.51 | — | — | — | — | — |
| VP 2017-C | 10.0 | — | — | — | 1.00 | — | — | — | — |

TABLE 1-continued

| | | FORMULATIONS (Grams/100 grams) | | | | | | | |
|---|---|---|---|---|---|---|---|---|---|
| | | Mix Number | | | | | | | |
| Product | Activity (%) | A | B | C | D | E | F | G | H |
| VP 2018-D | 13.0 | — | — | — | — | 0.77 | — | — | — |
| VP 2021-A | 18.0 | — | — | — | — | — | 0.56 | — | — |
| VP 2021-B | 18.0 | — | — | — | — | — | — | 0.56 | |
| Sandolite LP | 25.0 | — | — | — | — | — | — | — | 0.40 |

Each of the tested UV light absorber compositions was applied to a 10 g sample of grey-dyed, 100% automotive polyester yarn (knitted into a tube) in a water-based mock dye bath with a liquor ratio of 10:1. As indicated in Table 1, the concentration of each composition contained in the respective dye baths was adjusted such that 1% of active UV light absorbing agent to dry weight of yarn was used. Although not specifically tested, other suitable proportions ranging from about 0.4% to about 4.0% active UV light absorbing agent to dry weight of yarn are also applicable for achieving enhanced lightfastness of the yarn.

The yarn samples were subjected to the following test procedures using an "Ahiba Polymat" laboratory dyeing machine manufactured by Ahiba:

I. Prescour Procedure (a) Prepare 3 g/L of "Solpon 538-B" (scouring agent manufactured by Boehme Filatex Inc.);

(b) Add 200 mL of scour mix and knitted yarn sample to Ahiba Polymat;

(c) Heat to 160 degrees F. (71° C.) at 2° C. per minute;

(d) Hold at 71° C. for 30 minutes;

(e) Cool back to about 50° C.;

(f) Rinse knitted yarn samples under running warm tap water (about 120° F.) for about 5 minutes, and then under running cold tap water (about 70° F.) for 5 additional minutes;

(g) Air dry.

II. UV Light Absorber Application Procedure (a) Prepare UV light absorber mix;

(b) Check the pH and adjust to 4.8 with 1.0% Acetic Acid (96%);

(c) Add the UV light absorber mix and scoured, knitted yarn sample to the Polymat tube with liquor ratio of 10:1;

(d) Heat to 266 F. (130° C.) at 2° C. per minute;

(e) Hold at 130° C. for 30 minutes;

(f) Cool back to about 50° C.;

(g) Rinse knitted yarn samples under running warm tap water (about 120° F.) for about 5 minutes, and then under running cold tap water (about 70° F.) for 5 additional minutes;

(h) Dry each sample for 2 minutes at 120° C. (248° F.) in a Werner-Mathis laboratory drying/curing oven.

The treated yarn samples, together with an untreated sample, were then submitted to South Florida Test Service for automotive lightfastness testing. The basic test method conditions are indicated below in Table 2.

TABLE 2

| UV ABSORBER TEST METHOD CONDITIONS | |
|---|---|
| Test Method | GM 9125-P/SAE J 1885 |
| Exposure Device | Ci-65 #4 |
| Serial Number | CB-1431 |
| Light Source | Controlled Irradiance Xenon Arc |
| Filter Type | Quartz Inner, Borosilicate S Outer |
| Irradiance Level | .55 W/m$^2$ @ 340 nm |
| Elapsed Exposure | 300.8 kJ/m$^2$ Hours |
| Cam Number 60 | 3.5 Hours Light/1 Hour Dark |
| Black Panel Temperature | 89 ± 3° C. Light 38 ± 2° C. Dark |
| Dry Bulb Temperature | 62 ± 2° C. Light 38 ± 2° C. Dark |
| Relative Humidity | 50 ± 5% Light 95 ± 5% Dark |
| Spray Water Type | None |
| Spray Nozzle | N/A |
| Specimen Rotation | None |

A visual observation of the mock dye bath before and after treatment of the yarn samples is illustrated in Table 3. The clear appearance of the dye bath after treatment indicates excellent exhaustion of the UV light absorber active ingredient into the fibers of the particular yarn sample. A hazy or cloudy appearance of the dye bath indicates incomplete or poor exhaustion. As shown, the experimental VP 2305-B, VP 2305-C, and "Sandolite LP" compositions all showed relatively good exhaustion properties.

TABLE 3

| EXHAUSTION OBSERVATION | | |
|---|---|---|
| | Visual Observation | |
| Product | Before | After |
| VP 2305-A | White opaque liquid | Cloudy with brown tint |
| VP 2305-B | Pearlescent, white opaque liquid | Clear water white |
| VP 2305-C | Hazy, white opaque liquid | Clear water white |
| VP 2017-C | Hazy, white opaque liquid | Hazy liquid with brown tint |
| VP 2018-D | Hazy liquid | Hazy liquid with brown tint |
| VP 2021-A | Hazy, white opaque liquid with particles | Slightly hazy liquid |
| VP 2021-B | Hazy, white opaque liquid with particles | Hazy liquid with blue tint |
| Sandolite LP | White opaque liquid | Clear water white |

Colormetric data regarding the tested UV light absorber compositions is provided in Table 4. After UV light exposure, the experimental VP 2305-B composition provided the greatest fade-resistance with the "Sandolite LP" being ranked second.

UV ABSORBERS — COLORMETRIC DATA

| Specimen | Original | | | Present | | | Delta | | | | AATCC Gray Scale | Visual |
|---|---|---|---|---|---|---|---|---|---|---|---|---|
| Number | L* | a* | b* | L* | a* | b* | L* | a* | b* | E* | Color Change | Ranking |
| Control (No UV Absorber) | 63.98 | 3.70 | −2.00 | 67.80 | 4.16 | −1.90 | 3.82 | 0.46 | 0.10 | 3.85 | 2.5 | 6 |
| VP 2305-A | 63.98 | 3.70 | −2.00 | 65.38 | 4.25 | 0.00 | 1.40 | 0.55 | 2.00 | 2.50 | 2.5 | 7 |
| VP 2305-B | 62.98 | 4.08 | 0.03 | 66.59 | 4.08 | −0.06 | 3.61 | 0.00 | −0.09 | 3.61 | 3.5 | 1 |
| VP 2305-C | 63.06 | 4.01 | 0.04 | 70.38 | 2.35 | 0.62 | 7.32 | −1.66 | 0.58 | 7.53 | 3.0 | 3 |
| VP 2017-C | 64.95 | 3.29 | −1.62 | 68.62 | 4.02 | −0.61 | 3.67 | 0.73 | 1.01 | 3.88 | 2.0 | 8 |
| VP 2018-D | 64.52 | 3.87 | −1.14 | 65.75 | 4.31 | −0.56 | 1.23 | 0.44 | 0.58 | 1.43 | 2.5 | 9 |
| VP 2021-A | 62.92 | 4.07 | −0.51 | 66.68 | 4.13 | −0.35 | 3.76 | 0.06 | 0.16 | 3.76 | 4.0 | 5 |
| VP 2021-B | 63.28 | 4.41 | −0.28 | 64.47 | 3.27 | 1.39 | 1.19 | −0.87 | 1.67 | 2.23 | 2.5 | 4 |
| Sandolite LP | 62.41 | 3.57 | 1.10 | 67.23 | 4.76 | −0.76 | 4.82 | 1.19 | −1.86 | 5.30 | 3.5 | 2 |

In view of the above test results, it was concluded that experimental VP 2305-B of the present invention was comparable to "Sandolite LP" for exhaustion properties, and slightly better than the "Sandolite LP" for automotive lightfastness. The VP 2305-B composition includes the following:

67.5% by weight N-methyl-pyrrolidone (CAS Reg. No. 872-50-4);

22.5% by weight "Cyasorb UV-5411" UV light absorber from Cytec Industries; and 10.0% by weight "Tergitol D-683" emulsifier from Union Carbide.

A UV light absorber composition is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. A UV light absorber composition for improving the lightfastness of dyed synthetic textiles, consisting essentially of:

(a) 5–25% by weight of a substituted benzotriazole UV light absorbing agent;

(b) 75–95% by weight of a miscible organic solvent suitable for dissolving said benzotriazole, wherein said benzotriazole is applied to the textiles in a concentration sufficient to result in an add-on in the range of between 0.4–4.0% by weight of the textiles when dry and optionally an additional light stabilizer, antioxidant and a water immiscible solvent; and (c) about 2–25% by weight of a surfactant.

2. A UV light absorber composition according to claim 1, wherein the surfactant is nonylphenoxy-polypropyleneoxy-polyethyleneoxy-ethanol.

3. A UV light absorber composition for improving the lightfastness of dyed synthetic textiles, consisting essentially of:

(a) 5–25% by weight of a substituted benzotriazole UV light absorbing agent;

(b) 75–95% by weight of a miscible organic solvent suitable for dissolving said benzotriazole, wherein said benzotriazole is applied to the textiles in a concentration sufficient to result in an add-on in the range of between 0.4–4.0% by weight of the textiles when dry and optionally an additional light stabilizer, antioxidant and a water immiscible solvent; and (c) a surfactant as an emulsifier.

4. A UV light absorber composition for improving the lightfastness of dyed synthetic textiles, consisting essentially of:

(a) 5–25% by weight of a substituted benzotriazole UV light absorbing agent;

(b) 75–95% by weight of a miscible organic solvent suitable for dissolving said benzotriazole, wherein said benzotriazole is applied to the textiles in a concentration sufficient to result in an add-on in the range of between 0.4–4.0% by weight of the textiles when dry and optionally a surfactant, antioxidant and a water immiscible solvent; and (c) a light stabilizer selected from the group consisting of hindered amines and organo-copper complexes.

5. A UV light absorber composition for improving the lightfastness of dyed synthetic textiles, consisting essentially of:

(a) 5–25% by weight of a substituted benzotriazole UV light absorbing agent;

(b) 75–95% by weight of a miscible organic solvent suitable for dissolving said benzotriazole, wherein said benzotriazole is applied to the textiles in a concentration sufficient to result in an add-on in the range of between 0.4–4.0% by weight of the textiles when dry and optionally a surfactant, an additional light stabilizer and a water immiscible solvent; and (c) an anti-oxidant.

6. A UV light absorber composition for improving the lightfastness of dyed synthetic textiles, consisting essentially of:

(a) from about 10–45% by weight of 2-(2-hydroxy-5-tert-octylphenyl)-benzotriazole;

(b) from about 55–90% by weight of N-methyl-pyrrolidone solvent; and (c) wherein the benzotriazole of (a) is applied to the textiles in a concentration sufficient to result in an add-on in the range of between 0.4–4.0% by weight of the textiles when dry.

* * * * *